United States Patent [19]

Martwick et al.

[11] Patent Number: 5,029,530

[45] Date of Patent: Jul. 9, 1991

[54] CARTRIDGE CASE FOR A CASED TELESCOPED AMMUNITION ROUND

[75] Inventors: Wilford E. Martwick, Minneapolis; Brian B. Tasson, Maple Grove, both of Minn.

[73] Assignee: Honeywell Inc., Minneapolis, Minn.

[21] Appl. No.: 478,120

[22] Filed: Feb. 2, 1990

Related U.S. Application Data

[63] Continuation-in-part of Ser. No. 154,416, Feb. 10, 1988, Pat. No. 4,907,510.

[51] Int. Cl.[5] ..... F42B 5/02

[52] U.S. Cl. ..... 102/434; 102/430; 102/443; 102/464

[58] Field of Search ..... 102/430, 433, 434, 436, 102/440, 443, 464, 469

[56] References Cited

U.S. PATENT DOCUMENTS

| | | | |
|---|---|---|---|
| 2,362,738 | 11/1944 | Yarbrough | 102/464 |
| 4,681,038 | 7/1987 | Washburn | 102/464 |
| 4,907,510 | 3/1990 | Martwick et al. | 102/434 |

*Primary Examiner*—Harold J. Tudor

*Attorney, Agent, or Firm*—William T. Udsdeth; Edward W. Hughes

[57] ABSTRACT

A cartridge case 76 for a cased telescoped ammunition round 10. Cartridge case 76 includes a hollow cylindrical outer casing 12 the axis 18 of which is also the axis of symmetry of round 10. The inner surface of outer casing 12 has a longitudinal groove 50 formed in it along which groove 48 outer casing 12 splits when round 10 is fired. A front seal 20 closes the front end of casing 12 and a rear seal 22 closes the rear end of casing 12. A hollow cylindrical control tube 24 is secured to rear seal 22 so that control tube 24 is symmetric with axis 18. Three bolts 52, 53, 54 which are made of a material having a yield strength greater than the maximum stress to which the bolts 52, 53, 54 are subjected when round 10 is fired interconnect front and rear seals 20, 22. After round 10 is fired, bolts 52, 53, 54 return to their initial length, so that the length of the cartridge case returns to its initial length, and seals 20, 22 confine the casing 12 between seals 20, 22 to maintain the integrity of the spent cartridge case 76.

10 Claims, 2 Drawing Sheets

CARTRIDGE CASE FOR A CASED TELESCOPED AMMUNITION ROUND

CROSS REFERENCE TO RELATED APPLICATION

This application is a Continuation-in-part of application Ser. No. 154,416, filed Feb. 10, 1988, which issued as U.S. Pat. No. 4,907,510 on Mar. 13, 1990 by the same inventors.

BACKGROUND OF THE INVENTION (1) Field of the Invention

This invention is in the field of cased telescoped ammunition rounds, and more particularly relates to improvements to the cartridge cases of such rounds to facilitate removal of the fired cartridge cases from the chambers of guns, particularly those having a high rate of fire.

(2) Description of Related Art

Cased telescoped ammunition in which the projectile is completely enclosed, or telescoped, within the cartridge case, reduces the volume and weight of gun systems firing such ammunition compared with the weight and volume of gun systems using conventionally shaped ammunition rounds having an equivalent rate of fire. The reduced weight and volume for equivalent fire power makes such gun systems particularly desirable for mounting in aircraft, tanks, and other mobile combat vehicles, where a gun system includes a gun and its associated ammunition storage and feed mechanisms.

When a cased telescoped ammunition round is fired, the projectile is initially accelerated by a booster charge to close, or to obturate, the barrel of the gun before the main propellant charge is ignited. A control tube is commonly used to control the initial movement of the projectile. A booster charge is located in the control tube and is separated by the tube from the main propellant charge. Products of the ignited booster charge are initially confined within the control tube by a booster piston attached to the base of the projectile. Main charge ignition does not occur until the advancing piston clears the tube, or exposes or unblocks, ignition ports in the wall of the control tube. This permits products of the burning booster charge to ignite the main charge. Ignition of the main charge is controlled by the position of the projectile and its booster piston relative to the control tube.

The external surfaces of the cartridge case of a typical cased telescoped ammunition includes a cylindrical outer casing and a front seal and a rear seal. Each such round is loaded into a cylindrical chamber of the gun from which the round is to be fired, and from which the spent cartridge case is removed, or unloaded, before another cycle of loading, firing and unloading begins. In guns from which such rounds are typically fired, the chamber housing in which a number of gun chambers may be formed can take the form of a cylinder which is rotated about its axis of symmetry similar to the rotation of the cylinder of a hand held revolver, for example. In a gun system mounted in an aircraft, the rounds are mechanically loaded into a given chamber when that chamber has a given orientation, position, or station, relative to the gun barrel. The chamber is then rotated to bring the loaded chamber into alignment with the gun barrel ready for firing. After firing, the chamber housing is again rotated to another position so that the chamber with the cartridge case of the fired round, the spent cartridge case, can be removed. Alternatively, the chamber housing may be moved linearly with respect to the gun barrel to position a chamber at a loading station where a round can be loaded into the chamber, the chamber housing is then moved to align the loaded chamber with the gun barrel. When the round is fired, the chamber housing is moved so that the chamber with the spent cartridge case is at its unloading station where the spent cartridge case is removed prepatory to another round being loaded into it. In such a gun, the loading and unloading stations for a given chamber may be the same. Cased telescoped ammunition obviously can also be fired from more conventionally operating guns firing projectiles of from 20 to 45 mm. for example.

When the interior of the cartridge case is pressurized by the burning of the propellant within the cartridge, the outer skin, or outer casing, serves to contain the propellant and to locate the end seals within the chamber so that the lips of the seals will properly seal the ends of the gun chamber to prevent gun gas from escaping. The pressure created by the burning propellant forces the end seals apart until they are constrained by the breech face of the gun forming one end of the chamber and by the the barrel face of the gun barrel which forms the other end of the chamber. This pressure also forces the outer casing, or skin, of the cartridge case radially outward into intimate contact with the inner cylindrical surface of the chamber. After such contact has been achieved, the pressure produced by the burning propellant acts to elastically deform the chamber housing, enlarging the diameter of the chamber and forcing apart the breech face and the barrel face of the gun. When the pressure within the cartridge case is relieved by the exit of the projectile from the muzzle of the gun barrel, the gun and chamber housing revert to their unpressurized dimensions. However, changes in the dimensions of the cartridge case experienced during firing cause plastic deformation, or nonelastic changes in the dimension of the cartridge case, particularly when the cartridge case is fabricated of material having a relatively low yield strength such a low carbon steel, so that the dimensions of the cartridge case do not return to their initial values.

To extract a spent cartridge case after it has been fired, it is necessary in guns with movable chamber housings to move the chamber housing so that the chamber in which the spent cartridge case is located is at its unloading position, or station. For such movement to take place as quickly as possible while requiring the minimum amount of force to accomplish such movement, it is necessary that there be sufficient clearance between the end seals of the spent cartridge case and the breech face and the barrel face of the gun to minimize any mechanical resistance to the movement of the chamber housing. To quickly and easily remove the spent cartridge case from the chamber, it is important that the outer casing not press against the inner cylindrical surface of the gun chamber, and that the spent cartridge case be sufficiently intact so that all components of the spent cartridge case can be removed together, or as an entity.

Because the elastic deformation of the typical gun firing cased telescoped ammunition is so large that it exceeds the yield strength of lower cost materials from which it is economically desirable that such cartridge cases be fabricated, there is a need for an improved cartridge case for cased telescoped ammunition rounds that provides adequate and proper clearance between the end seals and the breech and barrel faces of the gun after the round has been fired as well as between the outer casing of the cartridge case and the surface of the chamber in the chamber housing while maintaining the integrity of the spent cartridge case to facilitate its removal, and in which the use of more expensive materials is minimized to minimize the cost of manufacturing such rounds.

To reduce the pressure exerted by the outer casing of the cartridge case of a telescoped ammunition round against the surface of the chamber after the round is fired; and, thus the force needed to remove the spent cartridge case the outer casing, is typically split longitudinally or is designed so to split when fired. Such splitting prevents any pressure being exerted by the outer casing against the inner surface of the chamber when the chamber returns to its initial dimensions. In such rounds the end seals move relative the the outer casing to accommodate changes in the distance between the breech and barrel faces of the gun, which requires special means to maintain the integrity of the cartridge case so that all components of the spent cartridge case can be removed as a single entity. Typically, the joint between the end seals and the outer casing includes a sealant to prevent moisture and contaminants from entering the round, but such joints are not strong enough to maintain the integrity of a spent cartridge case with the degree of reliability required so that the problem of removing a spent prior art cartridge case as a single entity quickly, and completely with a minimum amount of energy was not consistently achieved.

SUMMARY OF THE INVENTION

The present invention provides an improved cartridge case for a cased telescoped ammunition round. The cartridge case of the round includes a hollow cylindrical outer casing the axis of which is also the axis of symmetry of the round, front and rear seals, a control tube and an igniter. The inner surface of the outer casing is scored longitudinally which allows the outer casing to split when the round is fired. The front and rear portions of the outer casing are positioned within the lips of the front and rear seals. The hollow cylindrical control tube is secured to the rear seal so that the control tube is symmetric with the axis of symmetry of the round. A projectile which has a booster piston secured to its base is located within the cartridge case with the booster piston positioned in the control tube. A booster propellant is positioned within the control tube between the primer and the free end of the booster piston. The primer which ignites the booster propellant is mounted in the rear of the control tube. The main propellant charge is positioned around the control tube and the projectile, within the outer casing, and between the front and rear seals. Three uniformly spaced rods, bolts, or screws interconnect the front and rear seals. The rods are made of a material having a sufficiently high yield strength so that the pressure of the burning propellant acting on the front and rear seals elastically deforms the rods. Thus, after a round is fired, the rods return to their original, or initial, length which provides adequate clearance between the seals of the cartridge case and the breech and barrel faces of the gun. As a result, the seals do not press against the barrel and breech faces of the gun after the cartridge is fired, and no significant frictional, or other force attributable to the seals resists movement of the chamber housing. The connection between the seals of the casing provided by these rods also maintains the integrity of the spent cartridge case by mechanically confining the split outer casing between the end seals so the the spent cartridge case can be removed as an entity from the gun chamber.

It is, therefore, an object of this invention to provide an improved cartridge case for a cased telescoped ammunition round in which the front and rear seals of the cartridge case are connected by rods made of a material which is elastically deformed during firing, and thereafter exert a force which acts to move the seals toward one another so that the length of the round after being fired returns to its original prefired length.

It is another object of this invention to provide a cartridge case for a cased telescoped ammunition round that facilitates removal of the spent cartridge case from the gun chamber from within which the round was fired.

It is yet another object of this invention to provide a cartridge case for a cased telescoped ammunition round in which the outer casing of the cartridge case splits when the round is fired and the connection between the end seals provided by a plurality of bolts maintains the integrity of the spent cartridge case.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be affected without departing from the spirit and scope of the novel concepts of the disclosure, and in which.

DETAILED DESCRIPTION

Figure 1:
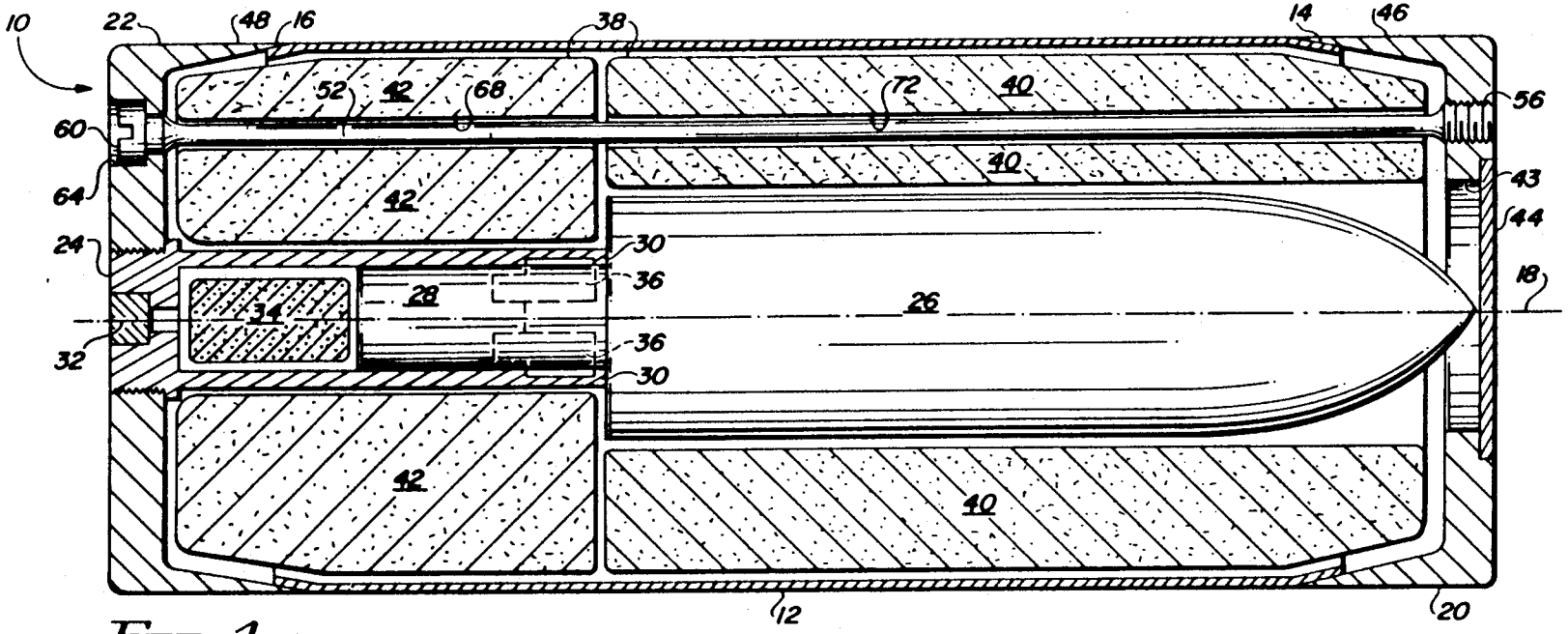
FIG. 1 is a longitudinal section of a cased telescoped ammunition round embodying this invention.

In FIG. 1 cased telescoped ammunition round 10 has a right circular cylindrical outer casing, or skin, 12 the front and rear edges, or portions, 14, 16 of which are tapered inwardly. Axis 18 of round 10 is the axis of symmetry, or longitudinal axis, of casing 12. Front seal 20 closes off the front end of casing 12, and rear seal 22 closes off the rear end of casing 12. Control tube 24 is a right circular hollow cylinder which is secured to rear seal 22 so that the axis of symmetry, or longitudinal axis of control tube 24 substantially coincides with axis 18. Projectile 26 is provided with a booster piston 28 which is mounted on the base of projectile 26, When projectile 26 is positioned within round 10, piston 28 is located within control tube 24. Segments, or spring fingers, 30 formed in control tube 24 press against booster piston 28 to resist movement of projectile 26 within control tube 24 and round 10 during normal handling prior to round 10 being fired. Primer, or igniter, 32 is mounted in the rear end of control tube 24, and booster charge 34 is positioned within control tube 24 between booster piston 28 and igniter 32. Ignition ports, or vents, 36 are formed through the side walls of control tube 24. Vents 36 are initially blocked, or closed, by booster piston 28. Two segments of the main propellant 38 of round 10, front segment 40 and rear segment 42, are positioned around control tube 24, around projectile 26, within outer casing 12, and between end seals 20 and 22. Segments 40, 42 are formed by consolidating propellant grains. The inner diameter of front segment 40 is greater than that of rear segment 42 so that forward segment 40 can fit around projectile 26 which has a greater diameter than control tube 22. The central opening 43 in front seal 18 is closed by environmental seal 44 which is made of a suitable material, such as aluminum foil. The function of seal 44 is to prevent elements of the environment external to round 10 such as moisture, dirt, etc. from entering round 10 and adversely affecting the performance of the round.

Front seal 20 is provided with a lip 46 and rear seal 22 is provided with a lip 48. When round 10 is assembled, the rear and front inwardly tapered portions 14, 16 of casing 12 fit within lips 46, 48 of seals 20, 22. The joints between seals 20, 22 and portions 14, 16 of casing 12 are environmentally sealed by a sealant such as a room temperature vulcanizing silicone which is not illustrated. The inner surface of casing 12 is scored, or has at least one longitudinal groove 50 formed in it. Groove 50 concentrates the stress applied to casing 12 when round 10 is fired to cause casing 12 to fail, or split, along groove 50.

Figure 3:
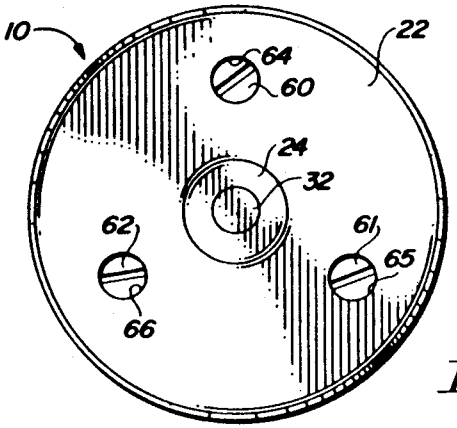
FIG. 3 is an elevation of the rear seal of the cartridge case.
Figure 2:
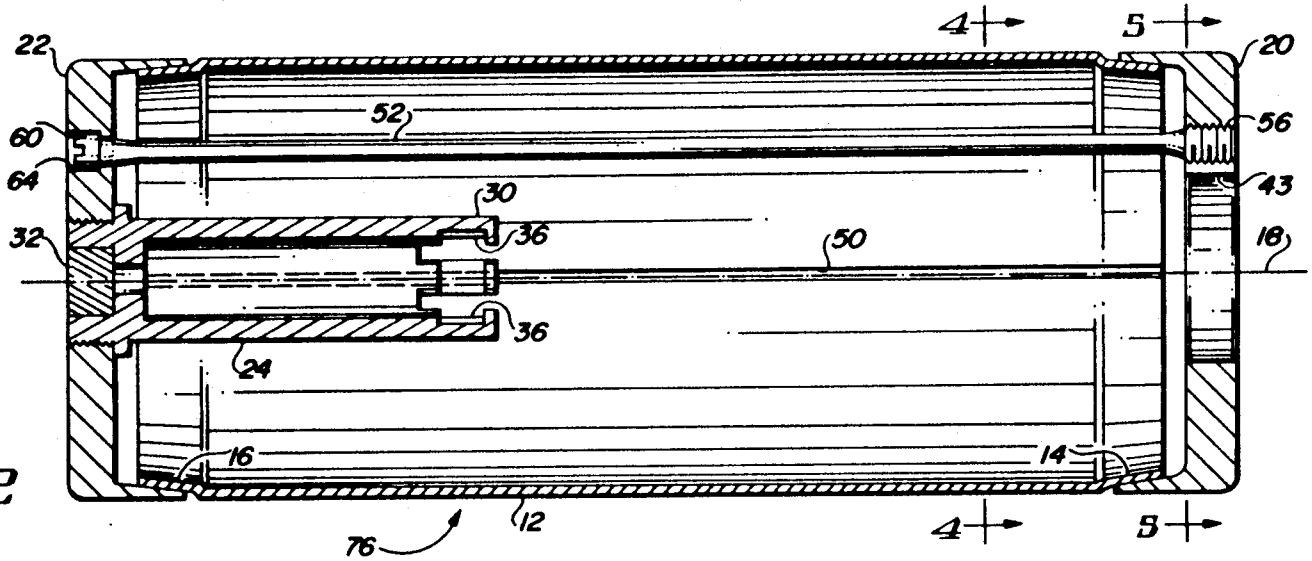
FIG. 2 is a longitudinal section of the cartridge case of this invention.
Figure 5:
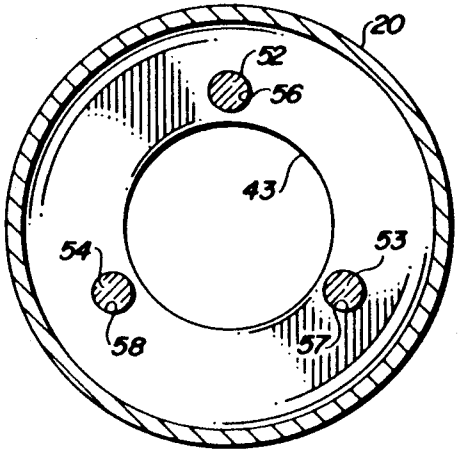
FIG. 5 is a section taken on line 5—5 of FIG. 2.
Figure 4:
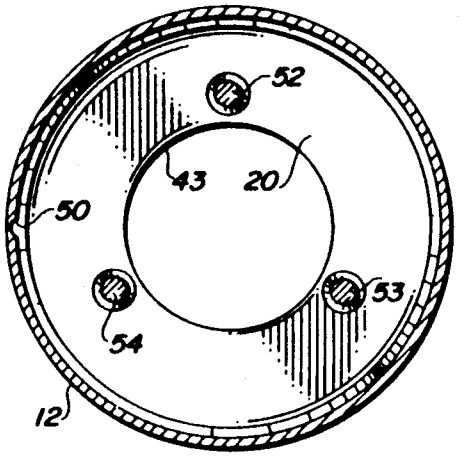
FIG. 4 is a section taken on line 4—4 of FIG. 2.

Front and rear seals 20, 22 are interconnected by three necked down rods, screws, or bolts 52, 53, 54, the threaded ends of each of which are threaded into three threaded bores 56, 57, 58 formed in front seal 20, as illustrated in FIG. 5. The heads 60, 61, 62 of screws 52, 53, 54 are received in three recesses 64, 65, 66 formed in rear seal 22. When round 10 is assembled, bolts 52, 53, 54 are substantially parallel to longitudinal axis 18, are spaced substantially equally distant from axis 18, and are substantially equiangularly arranged with respect to axis 18 as illustrated in FIGS. 3, 4, and 5. Bolts 52, 53, 54 are fabricated from a material having a yield strength, the stress level at which plastic deformation begins, or where the stress strain curve of the material departs from linearity, is well above that experienced by bolts 52, 53, 54 when round 10 is fired from a gun. A suitable material from which to fabricate bolts 52, 53, 54 is a stainless steel such as 17-7 PH stainless steel.

Round 10 is assembled by threadably securing control tube 24 in which primer 32 is positioned to rear seal 22. Booster charge 34 is positioned in control tube 24, segment 42 is placed around control tube 24, and booster piston 28 of projectile 26 is placed within control tube 24 as illustrated in FIG. 1. Bolts 52, 53, 54 are inserted through recesses 64, 65, and 66 formed in rear seal 22, and extend through three cylindrical bores formed in segment 42 only on of which, bore 68, is illustrated in FIG. 1. Front segment 40 is placed around projectile 26 so that bolts 52, 53, 54, extend through corresponding bores formed in segment 40, only one of which, bore 72, is illustrated in FIG. 1. The bores through segments 40, 42 through which bolts 52, 53, 54 extend are preferably formed when segments 40 42 are fabricated by consolidating grains of propellant.

Outer casing 12 is slipped over main propellant 38 with its tapered rear edge 16 positioned within lips 48 of rear seal 22 as illustrated in FIG. 1. Front seal 20 is positioned so that tapered front edge 14 of casing 12 is positioned within lips 46 of front seal 20 with the threaded bores 56, 57, 58 of front seal 20 aligned with the threaded ends of bolts 52, 53, 54. Bolts 52, 53, 53 are then rotated to cause their threaded ends to enter bores 56, 57, 58 to interconnect front and rear seals 20, 22 and to reduce the overall length of round 10 to its desired initial length. Environmental seal 44 closes the central opening 43 in front seal 20. The joint between tapered portions 14, 16 of casing 12 can be environmentally sealed by a room temperature vulcanizing silicone, for example.

In a typical gun system, which is not illustrated, a round 10 is loaded into a gun chamber in a chamber housing of the gun. The housing is moved to align the chamber containing round 10 with the gun barrel. The chamber, when a round is to be fired, is defined by the gun's breech face, the inner cylindrical surface of the gun chamber, and the face of the gun barrel. Round 10 is fired by a mechanism in the breech of the gun which drives a firing pin into primer 32, or by discharging an electrical current through primer 32 to initiate primer 32. Primer 32, when initiated ignites booster charge 34. Pressure of the gases released by burning booster charge 34 act on the exposed end of booster piston 28 to accelerate projectile 26 out of round 10 into the forcing cone of the gun barrel. As projectile 26 moves forward, booster piston 28 exposes, or unblocks, vents 36 in control tube 24 so that the burning booster charge 34 ignites main propellant 38 The burning propellant 38 produces gases having a very high pressure and temperature that act against seals 20, 22, outer casing 12, and projectile 26 to accelerate projectile 26 to a desired muzzle velocity as projectile 26 exits the gun barrel.

As the pressure of the gases produced by burning propellant 38 increases, the lips 46, 48 of end seals 20, 22 expand to seal the ends of the chamber so that little or no gun gas can escape from the chamber through any gaps between the housing and the breech and barrel faces of the gun. This pressure forces end seals 20, 22 apart until they are constrained by the breech and barrel faces of the gun which elastically elongates bolts 52, 53, 54. This pressure also forces the outer casing 12 outwardly against the inner cylindrical surface of the housing in which the chamber is formed. After such contact has been established and as the pressure of the gas within the cartridge case approaches its maximum, the magnitude of the pressure is sufficient to enlarge the diameter of the chamber as well as to force apart the breech and barrel faces of the gun. The stress on outer casing 12 is sufficient to cause outer casing 12 to split along groove 50, and the elongation of round 10 eliminates any fixed connection between seals 20, 22 and casing 12 resulting from the presence of any environmental sealant in the joints between seals 20. 22 and casing 12.

After projectile 26 exits the muzzle of the barrel, the pressure within cartridge case 76 which includes outer casing 12, end seals 20, 22, control tube 24, primer 32 and bolts 53, 53, 54 quickly decreases toward ambient at which time the gun and its chamber housing revert to their unpressurized dimensions.

Since outer casing 12 has split along longitudinal groove 50, any nonelastic deformation of outer casing 12 will not result in casing 12 pressing against the inner surface of the chamber from which round 10 is fired, and thus no force is created by outer casing 12 pressing against the surface of the chamber which would oppose removal of cartridge case 76. Since bolts 52, 53, 54 are made of a material which is elastically deformed, bolts 52, 53, 54 draw end seals 20, 22 toward each other and return case 76 substantially to its initial length. As a result, no forces are present to oppose movement of the chamber housing of the gun attributable to the seals 20, 22 pressing against the breech and barrel faces of the gun. Since seals 20, 22 are connected by bolts 52, 53, 54 and the tapered edges 14, 16 of casing 12 are within the lips 46, 48 of end seal 20, 22, the restoring force of bolts 52, 53, 54 applied to seals 20, 22 maintains the integrity of the spent cartridge case 76 so that all the elements of spent case 76 can be removed from a gun chamber as an entity and with a minimum expenditure of energy.

From the foregoing it should be evident that various modification can be made to the described invention without departing from the scope of the present invention.

What is claimed is:

1. A cased telescoped ammunition round comprising:

a hollow cylindrical outer casing made of a material which undergoes nonelastic deformation when the round is fired and having a front portion, a rear portion, an axis of symmetry, and a stress concentrating groove;

a front seal within which front portion of outer casing is positioned;

a rear seal within which the rear portion of the outer casing is positioned;

a hollow cylindrical control tube having a front end and a rear end, the rear end of the control tube being secured to the rear seal so that the control tube is substantially symmetrical with respect to the axis;

a plurality of metal rods interconnecting the front and rear seals, said rods being made of a material which undergoes elastic deformation when the round is fired;

a projectile having a base;

a booster piston mounted on the base of the projectile, the projectile being positioned within the outer casing with the piston being positioned within the control tube;

a main propellant charge positioned around the control tube, around the projectile, within the outer casing, and between the front and rear seals;

a booster propellant positioned within control tube; and primer means mounted in the control tube for igniting the booster propellant charge when initiated.

2. The cased telescoped ammunition round of claim 11 in which three metal rods 52, 53 54 interconnect front and rear seals 20, 22.

3. The cased telescoped ammunition round of claim 2 in which the rods are substantially parallel with the axis, substantially equidistant from the axis, and substantially equiangularly spaced with respect to the axis.

4. The cased telescoped ammunition round of claim 3 in which the rods are made of 17-7 PH stainless steel.

5. A cartridge case for a cased telescoped ammunition round comprising:

a hollow cylindrical outer casing made from a material having a yield strength less than the maximum stress to which the casing is subjected and having a front portion, a rear portion, an axis of symmetry, and a stress concentrating groove substantially parallel to the axis of symmetry;

a front seal within which the front portion of the casing is positioned;

a rear seal within which the rear portion of casing is positioned;

a hollow cylindrical control tube having a front end and a rear end, the rear end of control tube being secured to the rear seal so that the control tube is substantially symmetrical with respect to the axis, and the front end of the control tube is spaced from the front seal;

a plurality of bolts interconnecting the front and rear seals said bolts being made of a material having a yield strength greater that the maximum stress to which said bolts are subjected; and a primer 32 mounted in the rear end of control tube 24.

6. A cartridge case as set forth in claim 5 in which three bolts 52, 53, 54 interconnect seals 20, 22.

7. A cartridge case as set forth in claim 6 in which the bolts are substantially parallel to, substantially equidistant from, and substantially equiangularly spaced about the axis.

8. A cartridge case as set forth in claim 7 in which the bolts are threaded into three threaded bores formed in the front seal.

9. A cartridge case as set forth in claim 8 in which the bolts are fabricated of 177 PH stainless steel.

10. A cartridge case for a cased telescoped ammunition round comprising:

a right circular cylinder outer casing made from a material which undergoes nonelastic deformation when the round is fired and having a front portion and a rear portion, said front and rear portions being tapered inwardly, a longitudinal axis, a length parallel to the axis, and a stress concentrating groove extending the length of the casing;

a front seal having a circumferential tapered lip, the front portion of the casing being positioned within the tapered lip of the front seal;

a rear seal having a circumferential tapered lip, the rear edge of the casing being positioned within the tapered lip of the rear seal;

a hollow cylindrical control tube having a front end and a rear end, the rear end of the control tube being threadably secured to the rear seal, so as to be substantially symmetric with respect to the axis, and the front end being spaced from the front seal;

three rods interconnecting front and rear seals, said rods being substantially parallel to the axis, substantially equiangularly positioned with respect to the axis, and substantially equidistant from the axis, said rods being made of a material having a yield strength greater than the maximum stress to which the rods are subjected when the round is fired; and an igniter mounted in the rear end of the control tube.

* * * * *

UNITED STATES PATENT AND TRADEMARK OFFICE

CERTIFICATE OF CORRECTION

PATENT NO. : 5,029,530

DATED : July 9, 1991

INVENTOR(S) : Wilford E. Martwick, et. al.

It is certified that error appears in the above-identified patent and that said Letters Patent is hereby corrected as shown below:

Column 7, line 20, after "which" insert --the--; and after "of" insert --the--.

Column 7, line 46, after "interconnect" insert --the--.

Column 7, line 47, delete "20, 22".

Column 8, line 5, after "of" insert --the--.

Column 8, line 8, after "of" insert --the--.

Column 8, line 17, after "of" insert --the--.

Column 8, line 20, after "interconnect" insert --the--.

Column 8, line 29, after "7" in the first instance insert --a hyphen (-)--.

Signed and Sealed this

Twenty-ninth Day of December, 1992

*Attest:*

DOUGLAS B. COMER

*Attesting Officer*

*Acting Commissioner of Patents and Trademarks*